United States Patent [19]

Otsubo

[11] Patent Number: 4,953,212

[45] Date of Patent: Aug. 28, 1990

[54] AUTO VOICE CHANGING APPARATUS

[75] Inventor: Hiroshi Otsubo, Saitama, Japan

[73] Assignee: Pioneer Electronic Corporation, Tokyo, Japan

[21] Appl. No.: 426,261

[22] Filed: Oct. 25, 1989

[30] Foreign Application Priority Data

Nov. 29, 1988 [JP] Japan ..... 63-299705
Aug. 11, 1989 [JP] Japan ..... 1-206833

[51] Int. Cl.[5] ..... H04S 1/00
[52] U.S. Cl. ..... 381/1; 369/86
[58] Field of Search ..... 369/86, 91; 381/1, 2

[56] References Cited

U.S. PATENT DOCUMENTS 3,878,472 4/1975 Osakabe ..... 381/62
3,941,931 3/1976 Osakabe ..... 381/1
4,393,489 7/1983 Mehrotra ..... 369/86
4,847,816 7/1989 Kawahara et al. ..... 358/341

*Primary Examiner*—Forester W. Isen
*Attorney, Agent, or Firm*—Sughrue, Mion, Zinn, Macpeak & Seas

[57] ABSTRACT

An auto voice changing apparatus receives music from a stereo or multi-sound, digital or analog recording and either plays the recorded music as is, or uses the recorded music as instrumental accompaniment by eliminating the vocal sounds from the reproduced music and substituting vocal sounds provided through a microphone. The control is based solely on a single auto voice switch, control information from the recording, and detection of vocal sounds from the microphone.

8 Claims, 3 Drawing Sheets

AUTO VOICE CHANGING APPARATUS

BACKGROUND OF THE INVENTION

A music signal may include one or both of an instrumental portion and a vocal portion. The invention herein is directed to a system which can remove the vocal portion of a recorded music signal and add to the remaining instrumental portion, a vocal and/or instrumental signal introduced via a microphone. Alternatively, such systems can simply playback the entire reproduced signal from a recording/reproducing disk (hereinafter simply referred to as a "recording disk" or a "disk"). Such systems may be referred to as a voice changing system or apparatus.

As used herein, a music signal with no vocal portion is referred to as a play signal or a play portion. The vocal portion of a music signal is known as a sound signal or a sound & portion. Further, a so-called multi-sound disk is one in which a play signal only is stored in the left channel and play and sound signals are stored in the right channel. A stereo disk is one in which only play signal or both play and sound signals are stored in both right and left channels.

FIG. 3 is a block diagram showing the construction of a conventional voice changing apparatus.

In FIG. 3, an output signal of a microphone is supplied to a microphone input terminal $I_M$. The left and right channel music signals reproduced from a disk or the like are applied respectively to input terminals $I_L$ and $I_R$. The signals to be supplied to the input terminals $I_L$ and $I_R$ are previously demodulated by a known demodulating apparatus (not shown). Reference numerals $O_L$ and $O_R$ respectively designate output terminals of the left and right channels.

A microphone input detecting circuit 1 detects that the sound signal is supplied to microphone input terminal $I_M$ from the microphone. To prevent malfunction caused by external noise, the microphone input detecting circuit 1 has a band pass filter (BPF) for passing only frequencies within the band of the human voice and a level detecting circuit for detecting a human sound level. When the microphone input detecting circuit 1 detects the sound signal, it outputs a switching signal for controlling switch 2B, described later.

A multi-sound voice changing circuit 2 consists of a balance resistor 2A connected at both ends thereof to input terminals $I_L$ and $I_R$, and switch 2B for changing its contact from contact b to contact a upon receiving a changing signal from the microphone input detecting circuit 1. The switch 2B outputs the music signal, including the play and sound signals passing through the balance resistor 2A, when no changing signal is received and, on the other hand, outputs the play signal recorded in the left channel of the disk when the changing signal is received.

A stereo voice changing circuit 3 has band eliminating filters (BEFs) 3A and 3B for removing an intermediate frequency range such as 200 Hz to 4 KHz for example from the music signals of the left and right channels, & and has subtracting amplifier 3C for subtracting the music signal of the right channel from the music signal of the left channel to cancel the sound signal and reproduce the play signal. Stereo voice changing circuit 3 also has BPF 3D for passing the play signal outputted from subtracting amplifier 3C through an intermediate frequency range thereof, and has adder 3E for adding the play signal outputted from BPF 3D to the play signal outputted from BEF 3A to provide a play signal of the left channel. Stereo voice changing circuit 3 further has adder 3F for adding the play signal outputted from BPF 3D to the play signal outputted from BEF 3B to provide a play signal of the right channel.

In the stereo voice changing circuit 3 thus constructed, the sound signal recorded at an intermediate frequency range of the music signal is the same in phase in each of the left and right channels and is eliminated by the subtracting amplifier 3C. The remaining signal, having a frequency outside the intermediate frequency range of the filters 3A and 3B passes to the outputs of the filters. That is, the music signal without a sound signal, i.e., a play signal only can be obtained.

Selecting switch 4 selects the music signals of input terminals $I_L$ and $I_R$, and multi-sound voice selecting switch 5 selects the music or play signal outputted from multi-sound voice changing circuit 2. Stereo voice selecting switch 6 selects the play signal outputted from stereo voice changing circuit 3.

Left adder 7L and right adder 7R add an input signal of microphone input terminal $I_M$ to the music signals of input terminals $I_L$, $I_R$, the music or play signal outputted from multi-sound voice changing circuit 2, or the play signal outputted from stereo voice changing circuit 3. The music signal outputted from left adder 7L is supplied to output terminal $O_L$ and the music signal outputted from right adder 7R is supplied to output terminal $O_R$.

The operation of the above-mentioned apparatus will next be described.

First, when it is desired to listen to the music signals supplied to input terminals $I_L$ and $I_R$, without any signal removal, selecting switch 4 is closed (turned on) and simultaneously, multi-sound voice selecting switch 5 and stereo voice selecting switch 6 are open (turned off). Thus, the music signals supplied to input terminals $I_L$ and $I_R$ are supplied to output terminals $O_L$ and $O_R$ as they are.

When the above-mentioned apparatus is to be used as an instrumental accompaniment player and the recording disk is a multi-sound disk, selecting switch 4 and stereo voice selecting switch 6 are turned off and, simultaneously, multi-sound voice selecting switch 5 is turned on. In this condition, if no sound signal is supplied to microphone input terminal $I_M$, switch 2B remains switched onto the side of contact b, and accordingly, the music signals supplied to input terminals $I_L$ and $I_R$ are supplied to output terminals $O_L$ and $O_R$ through multi-sound voice changing circuit 2 as they are.

When a sound signal is supplied to microphone input terminal $I_M$, a switching signal is supplied to switch 2B from microphone input detecting circuit 1 so that switch 2B is switched onto the side of contact a. In this condition, the music signal at input terminal $I_L$, i.e., a play signal only, is supplied to adders 7L, 7R through multi-sound voice changing circuit 2. Accordingly, adders 7L and 7R add the sound signal supplied to microphone input terminal $I_M$ to the play signal outputted from multi-sound voice changing circuit 2 and supply the added signal to output terminals $O_L$ and $O_R$. Therefore, the play signal from the multi-sound disk which serves as background instrumental music to the vocals added by the microphone.

When the apparatus is to be used as an instrumental accompaniment player and the reproducing disk is a stereo disk, selecting switch 4 and multi-sound voice selecting switch 5 are turned off while stereo voice selecting switch 6 is turned on. In this condition, stereo voice changing circuit 3 outputs the play signal only derived by eliminating sound signal from the music signal, to adders 7L and 7R. When a sound signal is supplied to microphone input terminal $I_M$, first adders 7L and 7R add the microphone sound signal supplied to microphone input terminal $I_M$ and the play signal outputted from stereo voice changing circuit 3 to thereby output a music signal which is supplied to output terminals $O_L$ and $O_R$.

Therefore, the play signal, derived by eliminating the sound signal from the music signal, serves as background music, and is added to the microphone sound signal. That is, multi-sound voice changing circuit 2 and stereo voice changing circuit 3 act as a sound signal eliminating circuits, which eliminate sound signals in accordance with an interrelationship of recorded channels.

In the conventional voice changing apparatus constructed as above, the respective switches 4 to 6 must be set to predetermined operating states in accordance with the purpose of usage and the type of the reproducing disk used. In actual operation, this becomes complicated.

Further, when the respective switches 4 to 6 are incorrectly set, the apparatus cannot operate as intended.

SUMMARY OF THE INVENTION

To solve the above-mentioned problems, an object of the present invention is to provide an auto voice changing apparatus for performing the initial operation thereof by a simple operation.

An auto voice changing apparatus in accordance with the present invention comprises an auto voice switch for outputting an operating or non-operating signal in accordance with an operating or non-operating state thereof; a switching signal switch for discriminating a control signal reproducing control information of a reproducing disk and selecting the transmission or non-transmission of an output signal of a microphone input detecting circuit in accordance with the output signal of the auto voice switch; a voice switch for switching a music signal reproducing music information of the reproducing disk to a multi-sound voice changing circuit or a stereo voice changing circuit; and a switch control section for setting a selecting switch selecting an output signal of the uulti-sound voice changing circuit or a play signal of the stereo voice changing circuit to a predetermined operating state.

In the auto voice changing apparatus of the present invention, the switch control section discriminates the control signal reproducing the control information of the reproducing disk based on the output signal of the auto voice switch, and the switching signal switch and the voice switch and the selecting switch are set to predetermined operating states thereof. Therefore, an initial operation of the apparatus can be performed in accordance with the operating state of the auto voice switch.

DETAILED DESCRIPTION OF THE PREFERRED EMBODIMENT

One embodiment of an auto voice changing apparatus of the present invention will now be described on the basis of the accompanying drawings.

Figure 1:
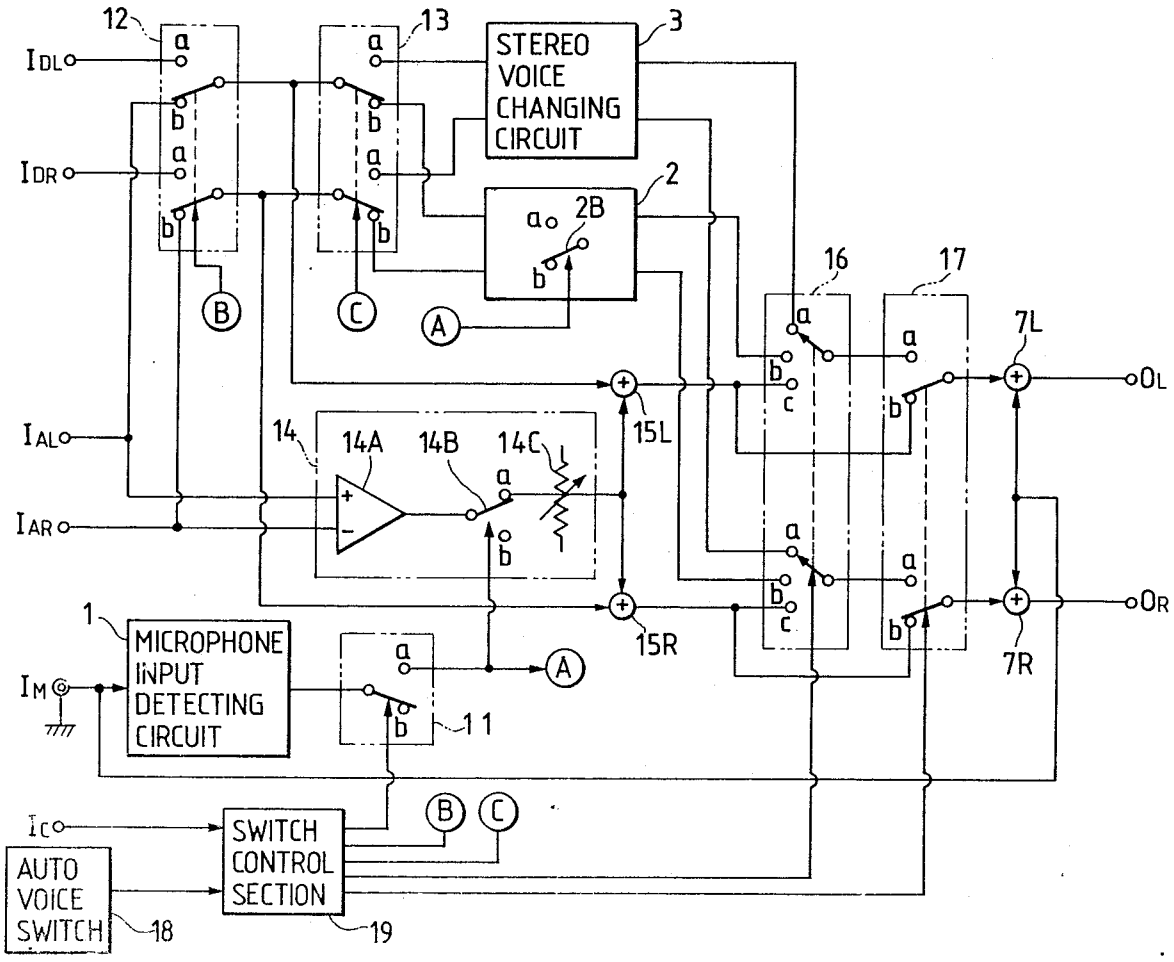
FIG. 1 is a block diagram showing the construction of an auto voice changing apparatus in one embodiment of the present invention.
Figure 3:
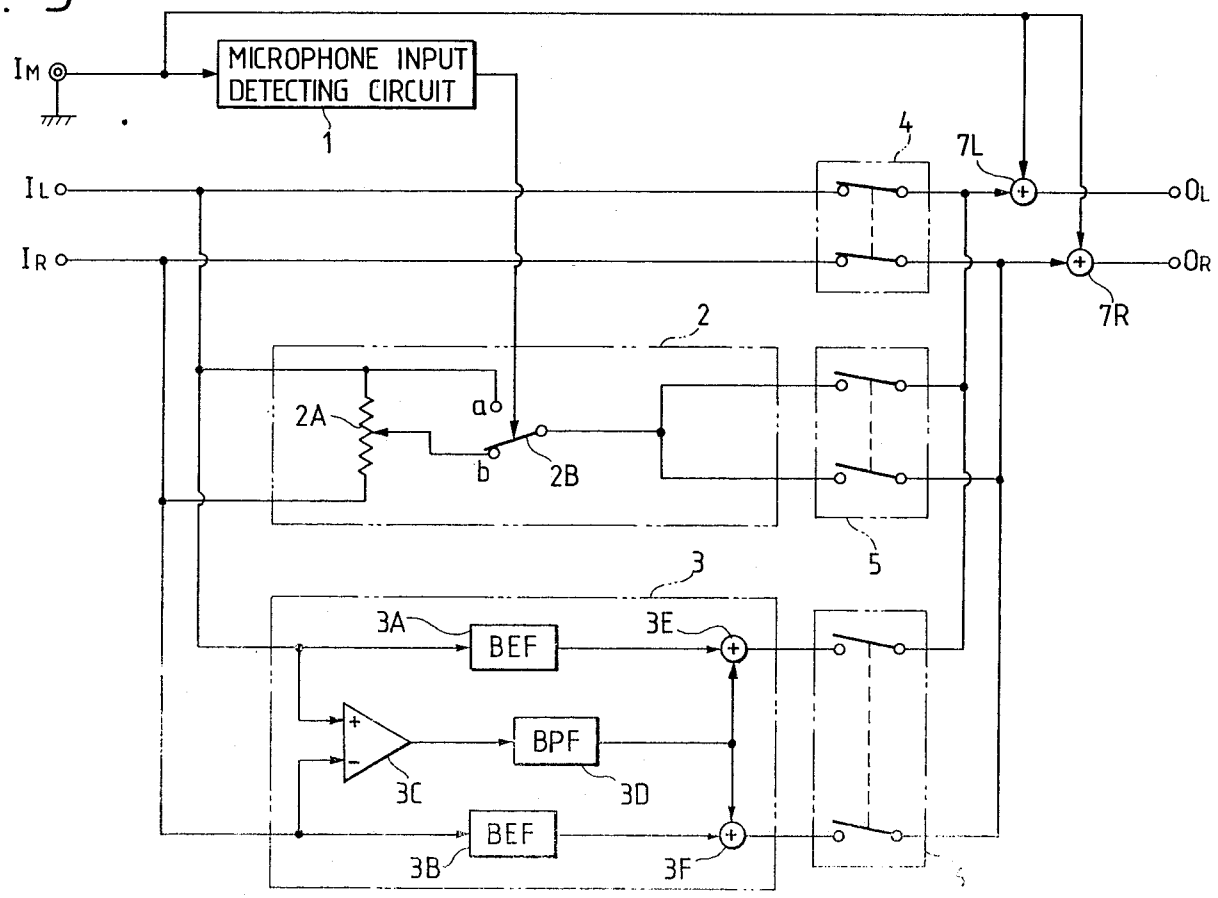
FIG. 3 is a block diagram showing the construction of the conventional voice changing apparatus.

FIG. 1 is a block diagram showing an auto voice changing apparatus according to an embodiment of the present invention. In FIG. 1, the same or corresponding portions to those in FIG. 3 are designated by the same reference numerals.

A digital music signal of a left channel reproduced from a disk is supplied to input terminal $I_{DL}$. A digital music signal of a right channel reproduced from the disk is supplied to input terminal $I_{DR}$. An analog music signal of the left channel reproduced from a disk is supplied to input terminal $I_{AL}$. An analog music signal of the right channel reproduced from the disk is supplied to input terminal $I_{AR}$. A control signal reproducing control information from the disk is supplied to input terminal $I_C$. The music signals to be supplied to the input terminals $I_{DL}$, $I_{DR}$ and $I_{AL}$, $I_{AR}$ are previously demodulated by a respective known demodulating apparatus (now shown).

It is assumed that the recording disks for use with the present invention have recorded thereon music in analog recorded form in either multi-sound or stereo, and may also include music recorded in digital form in either multi-sound or stereo. Also, control information recorded on the disk identifies the type of recorded information. Concerning recorded digital music information, in the following description, only a play signal is recorded on the left and right channels of the disk. A switch control section 19 provides switch control signals to switches 11, 12, 13, 16 and 17.

The switching signal switch 11 selects the transmission or non-transmission of a switching signal outputted from microphone input detecting circuit 1. The digital-/analog selecting switch 12 (which is called D/A switch in the following description) selects the digital or analog music signal. Voice switch 13 switches the music signal selected by D/A switch 12 to multi-sound voice changing circuit 2 or stereo voice changing circuit 3.

Sound signal extracting circuit 14 has subtracting amplifier 14A for subtracting the music signal of the right channel supplied to input terminal $I_{AR}$ from the music signal of the left channel supplied from input terminal $I_{AL}$ to produce a sound signal. Sound signal extracting circuit 14 also has switch 14B for selecting the sound signal outputted from subtracting amplifier 14A, and has volume thumbscrew 14C for adjusting the sound volume of the sound signal through switch 14B.

In the sound signal extracting circuit 14 thus constructed, when signals of the left and right channels recorded on the multi-sound disk are supplied to respective input terminals, a play signal which is commonly recorded in the left and right channels is thus eliminated and, accordingly, the sound signal, which is recorded in merely one of the channels, is actually outputted.

Adder 15L adds the sound signal outputted from sound signal extracting circuit 14 to the music signal of the left channel to provide an output signal of the left channel. Adder 15R adds the sound signal outputted from sound signal extracting circuit 14 to the music signal of the right channel to provide an output signal of the right channel.

That is, in case of reproducing a reproduction disk in which an analog signal is recorded in a multi-sound form while a digital signal is recorded in a stereo form, an analog sound signal extracted by the sound signal extracting circuit 14 is added to a digital play signal, to thereby obtaining a music signal containing a background music with high quality.

First selecting switch 16 selects the output signal of multi-sound voice changing circuit 2, the play signal of stereo voice changing circuit 3 or the output signals of first adders 15L and 15R. Second selecting switch 17 selects the selecting signal selected by selecting switch 16 or the output signals of first adders 15L and 15R.

Auto voice switch 18 outputs an operating signal in an operating state thereof and non-operating signal in non-operating state thereof. Switch control section 19 outputs a switching signal for setting switching signal switch 11, D/A switch 12, voice switch 13, first selecting switch 16 and second selecting switch 17, as described later, on the basis of the operating or non-operating signal outputted from auto voice switch 18 and the control signal supplied to input terminal $I_C$.

Adders 7L and 7R are referred to as second adders in the following description.

Figure 2:
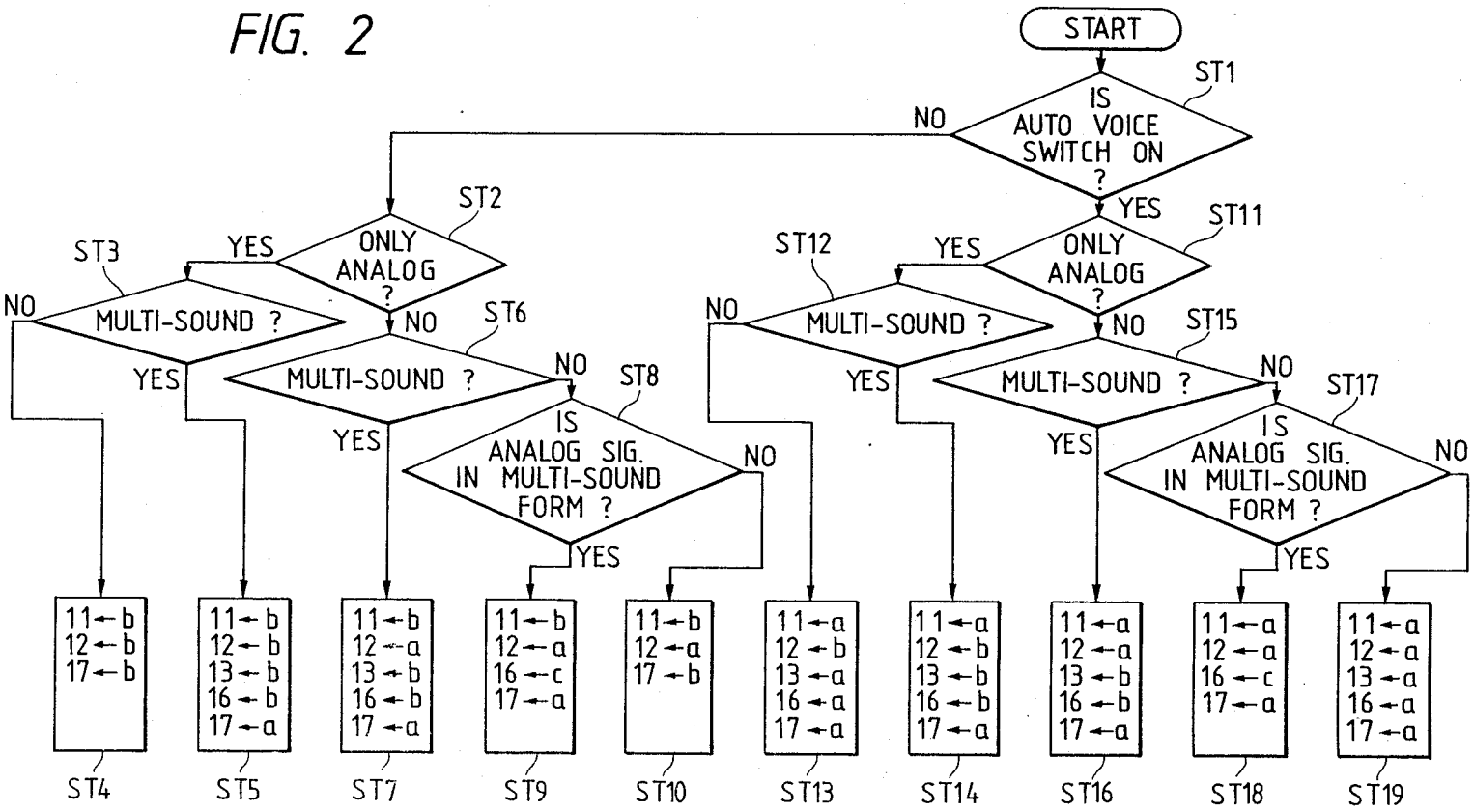
FIG. 2 is a flow chart for explaining the operation of the apparatus.

FIG. 2 is a flow chart for explaining the operation of the above-mentioned apparatus. With respect to steps ST1 to ST19, respective switches 11 to 13, 16 and 17 are designated by only reference numerals thereof in steps ST4, ST5, ST7, ST9, ST10, ST13, ST14, ST16, ST18 and ST19.

The operation of the above-mentioned apparatus will now be described.

When the electric power is turned on, the control information in a lead-in area of the reproducing disk is reproduced so that the flow chart of FIG. 2 starts. Afterwards, switch control section 19 judges whether auto voice switch 18 is in the operating state (the turned-on state) or not (step ST1). When auto voice switch 18 is in the non-operating state (the turned-off state), switch control section 19 also judges whether a digital signal is recorded on the disk (step ST2). If not, i.e., merely the analog signal is in recorded, the process goes to step ST3, wherein it is judged whether the music information is recorded in a multi-sound form. If not, i.e., the music information is recorded in a stereo form, the process goes to step ST4. Switching signal switch 11 is switched onto the side of contact b and D/A switch 12 is switched onto the side of contact b, and second selecting switch 17 is switched onto the side of contact b (step ST4).

By switching the respective switches 11, 12 and 17 as mentioned above, the music signals of input terminals $I_{AL}$ and $I_{AR}$ are supplied to output terminals $O_L$ and $O_R$ through D/A switch 12, first adders 15L, 15R, second selecting switch 17, second adders 7L, 7R.

Accordingly, the reproduced outputs of both the left and right channels can be obtained as they are, without any sound removal, which had been recorded in analog form on a stereo disk. It will be appreciated that all judgments in control section 19 are based on the status of auto voice switch 18 and the control signals at $I_c$.

If the music information is recorded in the multi-sound form and all other conditions are the same as described above, the process goes from ST3 to ST5. Switching signal switch 11 is switched onto the side of contact b, D/A switch 12 is switched onto the side of contact b, voice switch 13 is switched onto the side of contact b, first selecting switch 16 is switched onto the side of contact b, and second selecting switch 17 is switched onto the side of contact a (step ST5).

By switching the respective switches 11 to 13, 16 and 17 as mentioned above, switch 2B of the multi-sound voice changing circuit 2 is kept onto the side of contact b and, therefore, the music signals of input terminals $I_{AL}$ and $I_{AR}$ are supplied to output terminals $O_L$ and $O_R$ through D/A switch 12, voice switch 13, multi-sound voice changing switch 2, first selecting switch 16, second selecting switch 17 and second adders 7L, 7R.

Therefore, when the signals of the left and right channels are supplied to the multi-sound voice changing circuit 2, since switch 2B is kept onto the side of contact b, the signals of the left and right channels are combined with each other at a division ratio determined by balance resistor 2A (see FIG. 3). The combined signal is supplied to output terminals $O_L$ and $O_R$ so that the music containing the sound signal is attained.

If step ST2 judges that a digital signal is recorded on the disk (along with an analog signal), it is then judged at step ST6 whether the digital signal is recorded in the multi-sound form. If the music information is recorded in the multi-sound form, the switches are set as shown at step ST7. Switching signal switch 11 is switched onto the side of contact b, D/A switch 12 is switched onto the side of contact a, voice switch 13 is switched onto the side of contact b, first selecting switch 16 is switched onto the side of contact b, and second selecting switch 17 is switched onto the side of contact a.

By switching the respective switches 11 to 13, 16 and 17 as mentioned above, the music signal is supplied from input terminals $I_{DL}$ and $I_{DR}$ to output terminals $O_L$ and $O_R$ as in the same case as step ST5, and the music by the digital signal thus reproduced can be attained.

If, at step ST6, it had been determined that the digital signal had been recorded in the stereo format, the process goes to step ST8 where it is judged whether the analog signal is in the multi-sound form. When the analog signal is in the multi-sound form, switching signal switch 11 is switched onto the side of contact b, D/A switch 12 is switched onto the side of contact a, first selecting switch 16 is switched onto the side of contact c, and second selecting switch 17 is switched onto the side of contact a (step ST9).

By changing the respective switches 11 to 13, 16 and 17 as mentioned above, since switch 14B of sound signal extracting circuit 14 is kept onto the side of contact a, the music signal is supplied from input terminals $I_{DL}$ and $I_{DR}$ to first adders 15L and 15R through D/A switch 12, and more specifically, merely the sound signal of the analog signal which is extracted from the music signal supplied to input terminals $I_{AL}$ and $I_{AR}$ by sound signal extracting circuit 14 is supplied to first adders 15L and 15R. Afterwards, the music signal added by first adders 15L and 15R is supplied to output terminals $O_L$ and $O_R$ through first selecting switch 16, second selecting switch 17 and second adders 7L and 7R.

Accordingly, the operator can listen to the reproduced music, which is attained by adding the analog sound signal to the digital play signal.

If, at step ST8 it is detected that the analog signal is in the stereo form, the switches are set as in step ST10. Switch 11 is switched onto the side of contact b, D/A switch 12 is switched onto the side of contact a, and second selecting switch 17 is switched onto the side of contact b.

By switching the respective switches 11, 12 and 17 as mentioned above, the digital play signal can be outputted as it is.

In this case where the analog signal is supplied to the sound signal extracting circuit 14, the sound signal is eliminated and not outputted since the analog signals is recorded in a stereo-form, that is, the sound signal is recorded in the left and right channels. Therefore, no substantial analog signal is supplied to adders 15L and 15R and merely the digital play signal is outputted. Alternatively, in this condition, switch 14B may be switched to the side of contact b, if necessary.

Going back to step ST1, when auto voice switch 18 is in the operating state (the turned-on state), it is judged in step ST11 whether a digital signal is recorded onto the disk (along with the analog signal). If merely an analog signal is recorded, the process proceeds to step ST12, where it is judged whether the analog signal is recorded in the multi-sound form. If the music information is recorded onto the disk in the stereo form, the process proceeds to step ST13. Switching signal switch 11 is switched onto the side of contact a, D/A switch 12 is switched onto the side of contact b, voice switch 13 is switched onto the side of contact a, first selecting switch 16 is switched onto the side of contact a, and second selecting switch 17 is switched onto the side of contact a.

By switching the respective switches 11 to 13, 16 and 17 as mentioned above, the music signals of input terminals $I_{AL}$ and $I_{AR}$ are supplied to output terminals $O_R$ and $O_R$ through D/A switch 12, voice switch 13, stereo voice changing circuit 3, first selecting switch 16, second selecting switch 17 and second adders 7L, 7R, and the microphone sound signal is added to thus outputted music signal by second adders 7L and 7R.

Accordingly, a microphone sound signal can be added to the play signal functioning as a background music, which play signal is attained by eliminating the sound signal by stereo voice changing circuit 3.

If, at step ST12 it was detected that the music information was recorded onto the disk in the multi-sound form, the switches will be set as in ST14. Switching signal switch 11 is switched onto the side of contact a, D/A switch 12 is switched onto the side of contact b, voice switch 13 is switched onto the side of contact b, first selecting switch 16 is switched onto the side of contact b, and second selecting switch 17 is switched onto the side of contact a.

By switching the respective switches 11 to 13, 16 and 17 as mentioned above, the music signals of microphone input terminals $I_{AL}$ and $I_{AR}$ are supplied to output terminals $O_L$ and $O_R$ through D/A switch 12, voice switch 13, multi-sound voice changing circuit 2, first selecting switch 16, second selecting switch 17 and second adders 7L, 7R, thereby functioning as the same case as step ST5.

However, when a microphone sound signal is supplied to microphone input terminal $I_M$, switch 2B changes to the side of contact a and, therefore, the microphone sound signal is added by second adders 7L and 7R to the play signal outputted from multi-sound voice changing circuit 2, and the added signal is then supplied to output terminals $O_L$ and $O_R$. Accordingly, the microphone sound signal can be added to the play signal which is attained by eliminating the sound signal by multi voice changing circuit 2.

If, at step ST11 it was determined that a digital signal was recorded onto the disk, it is judged in step ST15 whether the digital signal was recorded onto the disk in the multi-sound form. If the digital music information was recorded in the multi-sound form the switches are set as in ST16. Switching signal switch 11 is switched onto the side of contact a, D/A switch 12 is switched onto the side of contact a, voice switch 13 is switched onto the side of contact b, first selecting switch 16 is switched onto the side of contact b, and second selecting switch 17 is switched onto the side of contact a.

By switching the respective switches 11 to 13, 16 and 17 as mentioned above, in case that no microphone sound signal is supplied to microphone input terminal $I_M$ and switch 2B of multi voice changing circuit 2 is kept on the side of contact b, the music signal supplied to input terminals $I_{DL}$ and $I_{DR}$ is supplied to output terminals $O_L$ and $O_R$ through D/A switch 12, voice switch 13, multi-sound voice changing circuit 2, first selecting switch 16, second selecting switch 17 and second adders 7L and 7R, thereby functioning as the same as step ST7.

However, if the microphone sound signal is supplied to microphone input terminal $I_M$, switch 2B changes to the side of contact a, the microphone sound signal is added by second adders 7L and 7R to the play signal which is obtained by eliminating the sound signal by multi-sound voice changing circuit 2, and the added music signal is supplied to output terminals $O_L$ and $O_R$.

If, at step ST15, it is determined that the music information was recorded onto the disk in the stereo form, it is judged in step ST17 whether the analog signal is in the multi-sound form. If the analog signal is in the multi-sound form, the switches are set as in step ST18. Switching signal switch 11 is switched onto the side of contact a, D/A switch 12 is switched onto the side of contact a, first selecting switch 16 is switched onto the side of contact c, and second selecting switch 17 is switched onto the side of contact a.

By switching the respective switches 11, 12, 16 and 17 as mentioned above, in case that no microphone sound signal is supplied to microphone input terminal $I_M$, the music signal of input terminals $I_{DL}$ and $I_{DR}$ is supplied to first adders 15L and 15R through D/A switch 12, and the music signal of input terminals $I_{AL}$ and $I_{AR}$ is supplied to sound signal extracting circuit 14 where merely the sound signal is extracted, and the extracted sound signal is supplied to first adders 15L and 15R. Therefore, the analog sound signal is added by first adders 15L and 15R to the digital play signal performing as a background music to thereby forming a music signal. which is supplied to output terminals $O_L$ and $O_R$ through first selecting switch 16, second selecting switch 17 and second adders 7L and 7R.

On the other hand, if a microphone sound signal is supplied to microphone input terminal $I_M$, switch 14B of second signal extracting circuit 14 changes to the side of contact b, so that no sound signal is supplied from second signal extracting circuit 14 to first adders 15L and 15R, and the microphone sound signal is added by second adders 7L and 7R to the digital play signal thereby forming a music signal which is supplied to output terminals $O_L$ and $O_R$.

Therefore, a microphone sound signal can be added to a digital play signal with high quality.

If, at step ST17, it is determined that the analog signal was recorded in the stereo form, the switches are set as in step ST19. Switching signal switch 11 is switched onto the side of contact a, D/A switch 12 is switched onto the side of contact a, voice switch 13 is switched onto the side of contact a, first selecting switch 16 is switched onto the side of contact a, second selecting switch 17 is switched onto the side of contact a.

By switching the respective switches 11 to 13, 16 and 17 as mentioned above, the music signals of input terminals $I_{DL}$ and $I_{DR}$ are supplied to output terminals $O_L$ and $O_R$ through D/A switch 12, voice switch 13, stereo voice changing circuit 3, first selecting switch 16, second selecting switch 17 and second adders 7L, 7R, as is the same as step ST10. The microphone sound signal is added to the output signal by adders 7L and 7R.

The switches which are not referred in the above-mentioned description do not relate to the above operations and therefore the description thereof is omitted.

The above-mentioned description is made with respect to the disk in which the play signal is recorded to both the right and left channels of the stereo disk. On the other hand, however, the operator can create a duet if he uses the above-mentioned apparatus as an instrumental accompaniment player in which the music signal including the sound signal is recorded on both the right and left channels of the disk.

As mentioned above, in accordance with the present invention, an auto voice changing apparatus comprises an auto voice switch for outputting an operating or non-operating signal in accordance with an operating or non-operating state thereof; a switching signal switch for discriminating a control signal reproducing control information of a reproducing disk and controlling the transmission of an output signal of a microphone input detecting circuit in accordance with the output signal of the auto voice switch; a voice switch for switching a music signal reproducing music information of the reproducing disk to a multi-sound voice changing circuit or a stereo voice changing circuit; and a switch control section for setting a selecting switch selecting an output signal of the multi-sound voice changing circuit or a play signal of the stereo voice changing circuit to a predetermined operating state. Accordingly, the switch control section discriminates the control signal based on the output signal of the auto voice switch, and the switching signal switch and the voice switch and the selecting switch are set to predetermined operating states. Therefore, the initial operation of the apparatus can be performed in accordance with the operating state of the auto voice switch.

Accordingly, the operation of the apparatus is simplified since the initial operation of the apparatus is performed by simply operating the auto voice switch.

What is claimed is:

1. An auto voice changing apparatus comprising:

a microphone input detecting circuit for outputting a switching signal when a sound signal is included in an input signal from a microphone;

a switching signal switch for controlling the transmission of the switching signal outputted from this microphone input detecting circuit;

a multi-sound voice changing circuit for outputting a music signal reproducing music information of a reproducing disk when no switching signal of said microphone input detecting circuit is supplied, said multi-sound voice changing circuit outputting a play signal by removing the sound signal from the music signal reproducing the music information of said reproducing disk when the switching signal of said microphone input detecting circuit is supplied;

a stereo voice changing circuit for outputting the play signal by removing the sound signal from the music signal reproducing the music information of said reproducing disk;

a voice switch for switching the music signal reproducing the music information of said reproducing disk to said multi-sound voice changing circuit or said stereo voice changing circuit;

a selecting switch for selecting the output signal of said multi-sound voice changing circuit or the play signal of said stereo voice changing circuit;

an adder for adding the sound signal from said microphone to the output signal of said multi-sound voice changing circuit selected by this selecting switch or the play signal of said stereo voice changing circuit;

an auto voice switch for outputting an operating signal in an operating state thereof and an non-operating signal in a non-operating state thereof; and a switch control section for discriminating a control signal reproducing control information of said reproducing disk and setting said switching signal switch, said voice switch and said selecting switch to predetermined operating states thereof in accordance with the output signal of said auto voice switch.

2. An auto voice changing apparatus, comprising:

(a) a pair of analog input terminals for receiving music signals representing left and right channels of analog recorded music signals, said signals being recorded in either stereo or multi-sound format;

(b) a pair of digital input terminals for receiving music signals representing left and right channels of digitally recorded music signals, said signals being recorded in either stereo or multi-sound format;

(c) a pair of output terminals for outputting the left and right channels of a music signal;

(d) a microphone input terminal for receiving sound signals from a microphone;

(e) a pair of output adder circuits having their outputs applied respectively to said pair of output terminals; one input terminal of each said adder circuit being connected to receive the sound signals at said microphone input terminal;

(f) a stereo voice changing circuit for removing the voice portion of stereo music signals applied thereto;

(g) a multi-sound voice changing circuit for receiving a multi-sound input signal and selectively outputting a music signal with voice or a music signal without voice;

(h) an auto voice switch for selecting an operating and a non-operating voice switch condition for said apparatus;

(i) switch control section means responsive to information produced from a recording disk and to the condition of said auto voice switch for providing switch control signals; and (j) multiple switching means for selectively routing signals on said analog and digital input terminals via selected ones of said stereo voice changing circuit and said multi-sound voice changing circuit to second inputs of said output adder circuits in accordance with said switch control signals.

3. An auto voice changing apparatus as claimed in claim 2, wherein said multi-sound voice changing circuit comprises a pair of input terminals for receiving the left and right channels of a multi-sound music signal, a pair of output terminals, a balance resistor connected across said input terminals, a multi-sound voice changing switch having a stationary terminal connected to both output terminals, a first contact connected to a central portion of said balance resistor, and a second contact connected to said input terminal for receiving said left channel, whereby when said switch connects said first contact with said stationary terminal, both output terminals output full music plus voice appearing on the combined input terminals and when said switch connects said second contact to said stationary terminal, said output terminals output music without voice as it appears at the input terminal for said left channel.

4. An auto voice changing apparatus as claimed in claim 3, further comprising sound detecting means connected to said microphone input terminal for detecting the presence of a vocal sound at said microphone input terminal and outputting a sound detection control signal; and wherein said multiple switching means comprises a switching signal switch for connecting said sound detection control signal to said multi-sound voice changing circuit to cause said multi-sound voice changing switch to connect said second contact to its stationary contact.

5. An auto voice changing apparatus as claimed in claim 4, wherein said switching means further comprises, a digital/analog switch for selectively connecting either said analog inputs or said digital inputs to the outputs thereof; a voice switch for selectively connecting the outputs of said digital/analog switch to either said stereo voice changing circuit or said multi-sound voice changing circuit.

6. An auto voice changing apparatus as claimed in claim 5, further comprising a sound extracting circuit having a pair of inputs connected respectively to said analog input terminal, a subtractor connected to said pair of inputs for providing a sound output therefrom, and a sound extracting circuit switch for selectively connecting or not connecting said sound output to an output of said sound extracting circuit; a second pair of adder circuits having their first inputs connected to receive the output from said sound extracting circuit and their second inputs connected to the outputs of said digital/analog switch.

7. An auto voice changing apparatus as claimed in claim 6, wherein said sound detection control signal is also connected via said switching signal switch to said sound extracting circuit for causing said sound extracting circuit switch to connect said subtractor output to said second adder circuits.

8. An auto voice changing apparatus as claimed in claim 7, wherein said multiple switching means further comprises, a first selecting switch for selectively connecting to a pair of outputs either said stereo voice changing circuit outputs, said multi-sound voice changing circuit outputs, or said second adder outputs; and a second selecting switch for selectively connecting either the outputs from said first selecting switch or the outputs from said second adders to the second inputs of said output adder circuits.

* * * * *